US005299532A

United States Patent [19]

Dietz

[11] Patent Number: 5,299,532

[45] Date of Patent: Apr. 5, 1994

[54] FLUIDIZED BED COMBUSTION SYSTEM AND METHOD HAVING MULTIPLE FURNACE AND RECYCLE SECTIONS

[75] Inventor: David H. Dietz, Hampton, N.J.

[73] Assignee: Foster Wheeler Energy Corporation, Clinton, N.J.

[21] Appl. No.: 976,026

[22] Filed: Nov. 13, 1992

[51] Int. Cl.[5] ..... F22B 1/00

[52] U.S. Cl. ..... 122/4 D; 110/245; 165/104.16; 422/141; 422/142; 422/146

[58] Field of Search ..... 122/4 D; 110/245; 165/104.16; 431/170; 422/141, 142, 146

[56] References Cited

U.S. PATENT DOCUMENTS

| | | |
|---|---|---|
| 3,893,426 | 7/1975 | Bryers . |
| 4,111,158 | 9/1978 | Reh et al. . |
| 4,165,717 | 8/1979 | Reh et al. . |
| 4,338,283 | 7/1982 | Sakamoto et al. . |
| 4,469,050 | 9/1984 | Korenberg . |
| 4,479,458 | 10/1984 | Goidich et al. . |
| 4,548,138 | 10/1985 | Korenberg . |
| 4,594,967 | 6/1986 | Wolowodiuk . |
| 4,617,877 | 10/1986 | Gamble . |
| 4,665,864 | 5/1987 | Seshamani et al. . |
| 4,682,567 | 6/1987 | Garcia-Mallol et al. . |
| 4,694,758 | 9/1987 | Gorzegno et al. . |
| 4,709,662 | 12/1987 | Rawdon . |
| 4,716,856 | 1/1988 | Beisswenger et al. . |
| 4,761,131 | 8/1988 | Abdulally . |
| 4,779,574 | 10/1988 | Nilsson et al. . |
| 4,809,625 | 3/1989 | Garcia-Mallol et al. . |
| 4,813,479 | 3/1989 | Wahlgren . |
| 4,854,249 | 8/1989 | Khinkis et al. . |
| 4,856,460 | 8/1989 | Wied et al. . |
| 4,860,693 | 1/1990 | Jarvstrat . |
| 4,896,717 | 1/1990 | Campbell, Jr. et al. . |
| 4,947,803 | 8/1990 | Zenz . |
| 4,947,804 | 8/1990 | Abdulally . |
| 4,969,930 | 11/1990 | Arpalahti . |
| 5,005,528 | 4/1991 | Virr . |
| 5,033,413 | 7/1991 | Zenz . |
| 5,040,492 | 8/1991 | Dietz . |
| 5,054,436 | 10/1991 | Dietz . |
| 5,069,170 | 12/1991 | Gorzegno et al. . |
| 5,140,950 | 8/1992 | Abdulally ..... 122/4 D |
| 5,141,708 | 8/1992 | Campbell, Jr. et al. ..... 422/142 |

OTHER PUBLICATIONS

U.S. patent application Ser. No. 07/673,919, Filed Mar. 25, 1991, inventor: Dietz, Fluidized Bed Combustion System And Method Having Multiple Furnace Sections.

*Primary Examiner*—Edward G. Favors

*Attorney, Agent, or Firm*—Marvin A. Naigur

[57] ABSTRACT

A fluidized bed combustion system and method in which a plurality of enclosures, each having a furnace section and integral recycle section are joined using common walls. Openings are provided in lower portions of the common walls for permitting the fluidized bed material to flow between adjacent or opposing furnace sections and between adjacent recycle sections. Openings are also provided in upper portions of the common walls for equalizing the gas pressure between the adjacent or opposing furnace sections.

29 Claims, 5 Drawing Sheets

FLUIDIZED BED COMBUSTION SYSTEM AND METHOD HAVING MULTIPLE FURNACE AND RECYCLE SECTIONS

BACKGROUND OF THE INVENTION

This invention relates to a combustion system and method, and, more particularly, to such a system and method in which a plurality of adjacent and opposing enclosures including furnace sections and recycle sections are provided for receiving fluidized beds.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

A typical fluidized bed utilized in the furnace section of these type systems is commonly referred to as a "bubbling" fluidized bed in which the bed of particulate material has a relatively high density and a well defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The external solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence time reduces the adsorbent and fuel consumption. U.S. Pat. Nos. 5,040,492 and 5,054,436, assigned to the same assignee as the present application, disclose systems in which the separated solids are recycled back to the furnace.

U.S. Pat. Nos. 4,609,623 and 4,809,625, assigned to the same assignee as the present application, disclose a fluidized bed reactor in which a dense, or bubbling, bed is maintained in the lower portion of the furnace, while the bed is otherwise operated as a circulating bed. This hybrid arrangement results in several advantages not the least significant of which is the ability to utilize fuel and adsorbent over a relatively large particle size range.

In designing fluidized bed combustion systems of the above types, increases in furnace capacity from a given design are usually achieved by increasing the height of the furnace walls. However, this is expensive and there are certain limits to the height of the walls. It has therefore been suggested that the size of the furnace, and therefore its capacity, be increased by increasing the size of the furnace in "plan view" i.e., increasing the width and/or the depth of the furnace. However, this usually requires a common wall, or the like, to be placed in the furnace section to divide the area into two or more fluidized beds which requires separate operating controls, etc. which is expensive. Also, the common wall is subjected to lateral loading, especially when the multiple beds operate differently or if one bed is rendered inoperable due to equipment failure. This lateral loading can cause damage to the wall and attendant reduction i operation and efficiency.

Increases in furnace capacity also lead to the use of larger cyclone separators which permit increasing amounts of fine, unburnt fuel particles to escape with the separated flue gases. This escape of unburnt fuel particles reduces fuel efficiency, thereby increasing fuel consumption.

SUMMARY OF THE INVENTION

It is therefore an object of the present invention to provide a fluidized bed combustion system and method which has an increased capacity without any increase in furnace wall height.

It is a further object of the present invention to provide a fluidized bed combustion system and method of the above type in which two or more separate enclosures having furnace sections are provided.

It is a further object of the present invention to provide a fluidized bed combustion system and method of the above type in which two or more enclosures having furnace sections and integral recycle sections are provided.

It is a further object of the present invention to provide a fluidized bed combustion system and method of the above type in which the enclosures are joined by common walls.

It is a still further object of the present invention to provide a fluidized bed combustion system and method of the above type in which separate furnace sections may be operated without the need for separate controls.

It is a still further object of the present invention to provide a fluidized bed combustion system and method of the above type in which separate integral recycle sections may be operated without the need for separate controls.

It is a still further object of the present invention to provide a fluidized bed combustion system and method of the above type in which the common walls are vented to equalize the pressure across the walls, to minimize or eliminate lateral loading and to enable the fluidized beds in each furnace section to maintain substantially the same height.

It is a still further object of the present invention to provide a fluidized bed combustion system and method of the above type in which the common walls are vented to enable the fluidized beds in the integral recycle sections to maintain substantially the same height.

It is a still further object of the present invention to provide a fluidized bed combustion system and method of the above type in which fuel efficiencies are increased by reducing losses of fine, unburnt fuel particles.

Toward the fulfillment of these and other objects, according to the system and method of the present invention a plurality of enclosures, each having a furnace section and a recycle section, are joined using common walls A fluidized bed of particulate material is formed in each furnace section and recycle section and the flue gases in each furnace section entrain portions of the particulate material and rise upwardly in each furnace section before discharging to a cyclone separator or the like. Upper and lower portions of the common walls are vented to equalize pressure across the walls and to maintain substantially identical dense bed heights in the furnace sections and substantially identical dense bed heights in the recycle sections.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
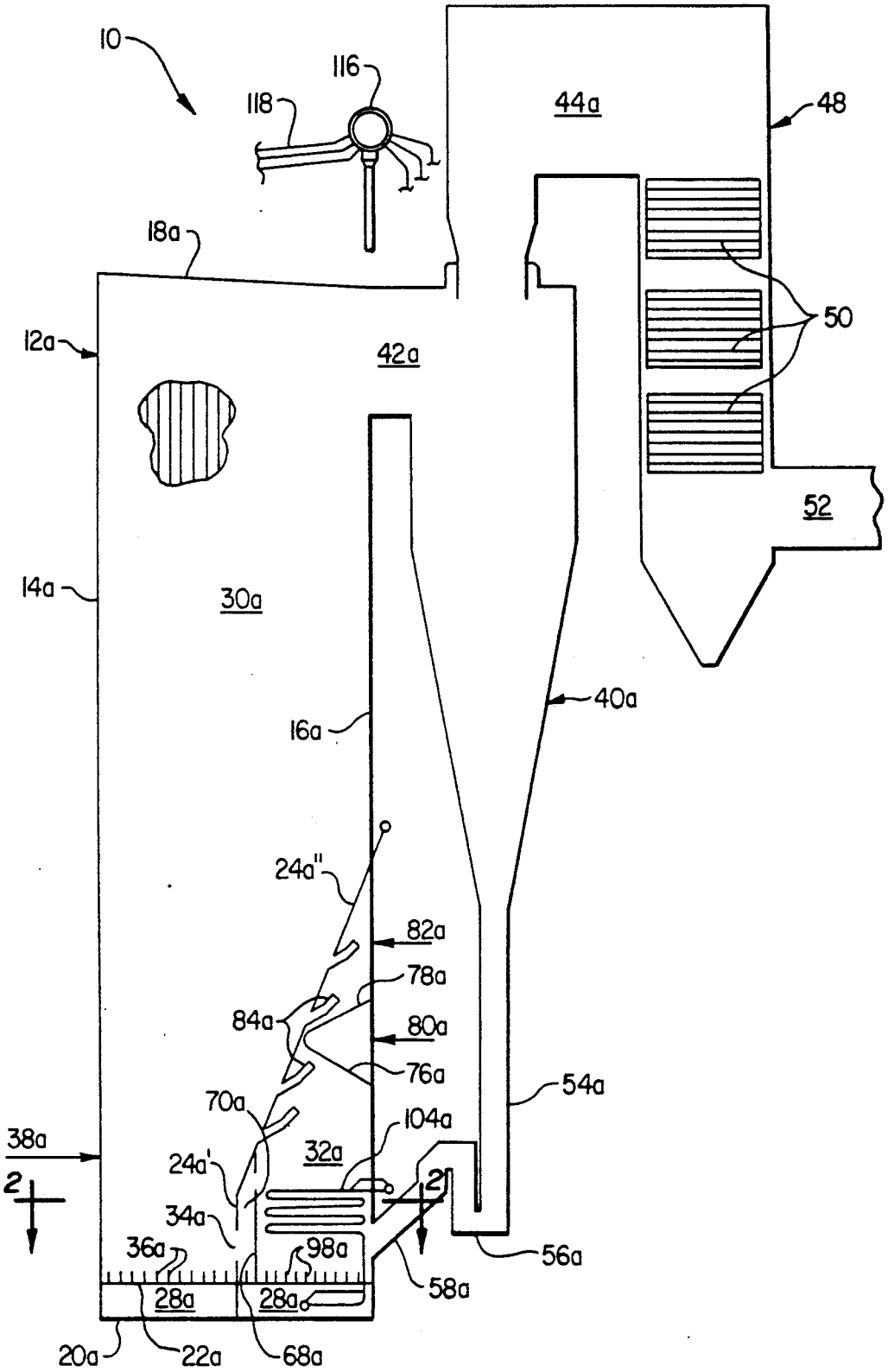
FIG. 1 is a schematic representation depicting the system of the present invention.
Figure 2:
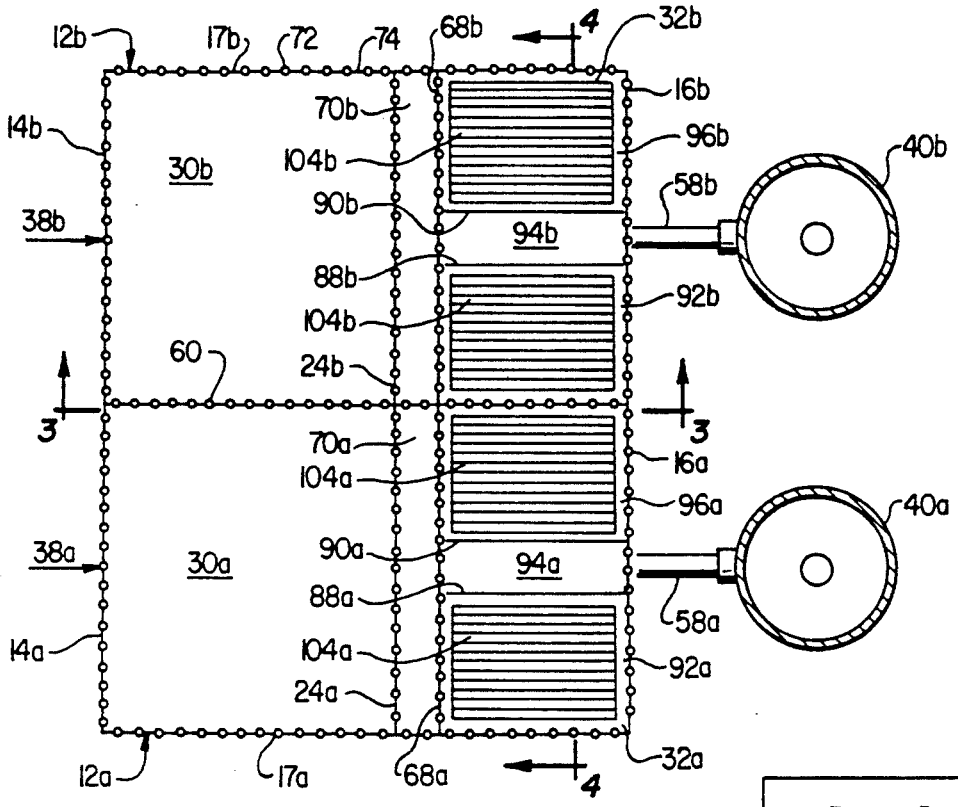
FIG. 2 is an enlarged cross-sectional view taken along the line 2—2 of FIG. 1.

Referring to FIGS. 1 and 2 of the drawings, the fluidized bed combustion system of the present invention is referred to in general by the reference numeral 10. The system 10 includes two upright water-cooled enclosures 12*a* and 12*b* which are substantially identical. For the convenience of presentation, only enclosure 12*a* will be described in detail.

The enclosure 12*a* has a front wall 14*a*, a rear wall 16*a* and two sidewalls, one of which is referred to by the reference numeral 17 and the other of which is formed by a common wall extending between the enclosures 12*a* and 12*b*, which will be discussed in detail later. The upper portion of the enclosure 12*a* is closed by a roof 18*a* and the lower portion includes a floor 20*a*. A distribution plate or grate 22*a* extends across a lower portion of the enclosure 12*a*. The plate 22*a* is spaced from the floor 20*a* to define a plenum area between the floor 20*a* and the plate 22*a* which is adapted to receive an oxygen-containing gas such as air from an external source (not shown).

A partition 24*a* is disposed in the enclosure 12*a* and extends between the side walls, including side wall 17*a*. The partition 24*a* includes a lower, substantially vertical portion 24*a*' which extends upwardly from the floor 20*a*, through the distribution plate 22*a*, and into the enclosure 12*a*. The partition portion 24*a*' is disposed parallel to the front and rear walls 14*a* and 16*a*. The partition 24*a* also includes an upper portion 24*a*" which angles upwardly and rearwardly from the lower portion 24*a*' of the partition to the rear wall 16*a*. The partition 24*a* thereby divides the plenum area into plenum chambers 26*a* and 28*a* and further divides the enclosure 12*a* into a furnace section 30*a* disposed above plenum chamber 26*a* and a recycle section 32*a* disposed above plenum chamber 26*a*. At least one opening 34*a* is provided in a lower portion of the vertical partition portion 24*a*' for reasons to be described. A plurality of air distributor nozzles 36*a* are mounted in corresponding openings formed in the portion of the plate 22*a* extending under the furnace section 30*a* for passing air through the plate 22*a*, for reasons to be described.

A feeder system 38*a* is provided adjacent the front wall 14*a* for introducing particulate material into the furnace section 30*a*. The particulate material includes fuel and may also include other components including an adsorbent, such as limestone.

The particulate material is fluidized in the furnace section 30*a* by the air from the plenum 26*a* as it passes upwardly through the plate 22*a*. This air promotes the combustion of the fuel, generating combustion gases which combine with the air to form flue gases which rise in the furnace section 30*a* by convection and which entrain a portion of the particulate material as will be described.

A cyclone separator 40*a* extends adjacent the enclosure 12*a*. As shown in FIG. 1, a duct 42*a* extends from an outlet opening provided in the rear wall 16*a* of the enclosure 12*a* to an inlet opening provided through the wall of the separator 40*a*. The separator 40*a* receives flue gases and entrained particulate material from the furnace section 30*a* in a manner to be described and operates in a conventional manner to disengage the particulate material from the flue gases. The separated flue gases in the separator, which are substantially free of solids, pass, via a duct 44*a* located immediately above the separator, into a heat recovery section 48, via an inlet provided through a wall thereof.

The heat recovery section 48 includes a plurality of heat exchange surfaces 50 which may serve as heaters, reheaters, superheaters, and economizers, all of which are formed by a plurality of heat exchange tubes extending in the path of the gases as they pass through the heat recovery section 48. After passing across the heat exchange surfaces 50, the gases exit the heat recovery section 48 through an outlet 52. It is preferred that a number of separators associated with additional enclosures be connected to a single heat recovery section 48. It is understood that a number of different embodiments of heat recovery sections may be used. For a more detailed discussion of a preferred embodiment of a heat recovery section, see U.S. Pat. Nos. 5,040,492 and 5,054,436, both assigned to the assignee of the present invention. The disclosure of these references is incorporated herein by reference.

As shown in FIG. 1, the lower portion of the separator 40*a* is conically shaped and is connected to a dip leg 54*a* which, in turn, is connected to a J-valve 56*a*. A conduit 58*a* connects the outlet of the J valve 56*a* to the recycle section 32*a* to transfer the separated particulate material from the separator 40*a* to the recycle section 32*a*. The J valve 56*a* functions in a conventional manner to prevent back-flow of solids from the furnace section 30*a* and the recycle section 32*a* to the separator 40*a*. It is understood that a substantially identical separator, dip leg, J-valve and inlet conduit are associated with each enclosure and all function in a substantially identical fashion. It is also understood that other types of separators may be used, and the separators may pass the separated particulate material to the recycle sections in any conventional manner.

As shown in FIG. 2, the enclosures 12*a* and 12*b* are disposed adjacent one another and share a common wall 60 which extends from front walls 14a and 14b to rear walls 16a and 16b and which extends from the enclosure floors 20a and 20b to the enclosure roofs, including roof 18a. A furnace section 30b is formed in the enclosure 12b and is disposed adjacent the furnace section 30a, and a recycle section 32b located adjacent the furnace section 30b and is disposed adjacent the recycle section 32a.

Figure 3:
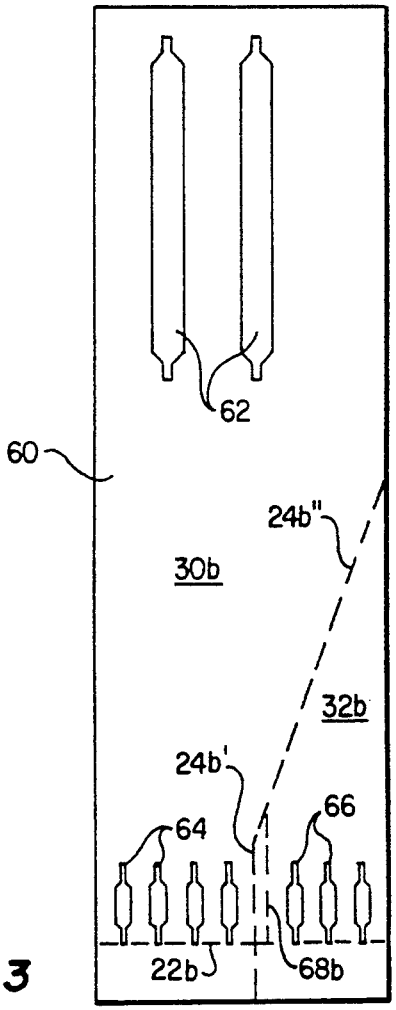
FIG. 3 is a reduced cross sectional view taken along the line 3—3 of FIG. 2.

As shown in FIG. 3, a plurality of openings 62 are provided in the upper portion of the common wall 60 and a plurality of openings 64 and 66 are provided in the lower portion of the common wall 60, for reasons to be described.

Figure 4:
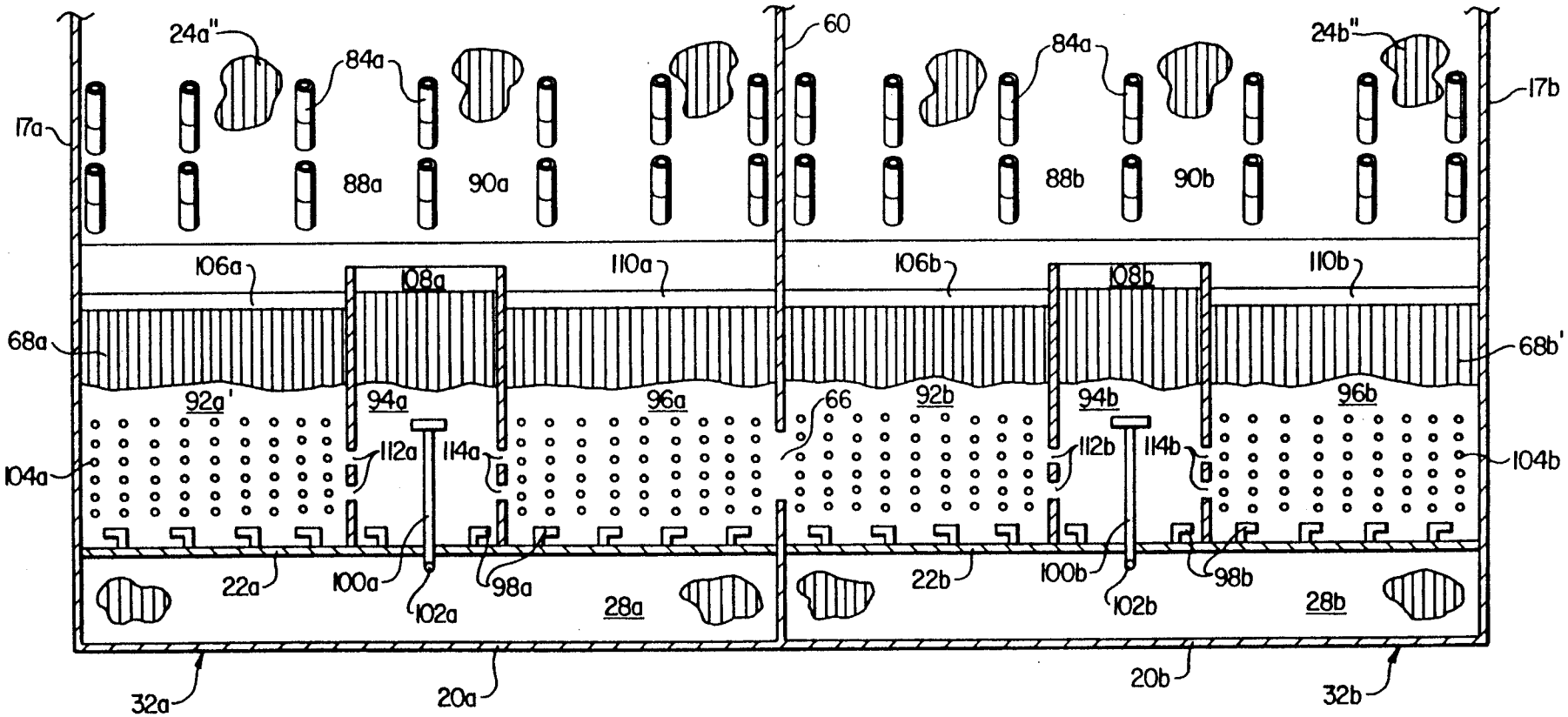
FIG. 4 is a cross-sectional view taken along the line 4—4 of FIG. 2.

FIGS. 2 and 4 depict the adjacent recycle sections 32a and 32b in greater detail. For convenience of presentation, the recycle section 32a will be described in detail, it being understood that the description also applies to the recycle section 32b, as well as to additional recycle sections such as those in FIGS. 5 and 6.

A partition 68a is disposed in the recycle section 32a and extends between the side wall 17a and the common wall 60 and parallel to the vertical partition portion 24a'. The partition 68a also extends from the distribution plate 22a to the angled portion 24a'' of the partition 24a to define a channel 70a between the partitions 24a and 68a. A plurality of openings are provided in an upper portion of the partition 68a for reasons to be described.

The front wall 14a, the rear wall 16a, the sidewalls, the roof 18a, the partitions 24a and 68a, and the walls of the separator 40a and heat recovery section 48 are all formed by a plurality of vertically-extending, spaced, parallel tubes 72 with adjacent tubes being connected by continuous fins 74 along their lengths to form airtight structures. As shown schematically in FIG. 1, a portion of the tubes 72 forming the rear wall 16a are bent out of the plane of the latter wall, towards the partition section 24a'' to form a partition 76a, and back to the rear wall 16a to form a partition 78a. The partitions 76a and 78a thus help support the partition section 24a''.

A pair of vertically-spaced secondary air inlets 80a and 82a register with openings in the rear wall 16a for introducing a secondary, oxygen-containing gas such as air into the enclosure 12a at two levels, one between the points of intersection of the partitions 76a and 78a with the rear wall 16a and another above the point of intersection of the partition 78a with the rear wall 16a. Although not clear from the drawings, it is understood that the tubes 72 forming the partition 76a have no fins so that secondary air from the inlet 80a can pass therethrough, while the tubes 72 forming the partition 78a are finned to prevent the passage of air therethrough and thus form a roof for the recycle section 32a.

As shown in FIG. 1, four rows of nozzles 84a extend through the partition portion 24a'', with two rows located above the partition 78a and two rows located below the partition 78a. As a result, secondary air from the inlet 80a is directed through the lower two rows of nozzles 84a, and secondary air from the inlet 82a is directed through the upper two rows of nozzles 84a.

As best shown in FIGS. 2 and 4, partitions 88a and 90a are disposed within the recycle section 32a and extend between the rear wall 16a and the partition 68a, substantially parallel to the side wall 17a and the common wall 60. The partitions 88a and 90a extend upwardly from the distribution plate 22a to a desired height within the recycle section 32a. Referring to FIG. 4, the partitions 88a and 90a divide the lower portion of the recycle section 32a into three compartments 92a, 94a and 96a. As shown in FIG. 2, the inlet conduit 58a registers with an opening in the rear wall 16a communicating with the compartment 94a.

Within the recycle section 32a, a plurality of rows of nozzles 98a extend through the perforations in the plate 22a above plenum chamber 28a. Each nozzle 98a consists of a central portion extending through the perforation and a horizontal discharge portion registering with the vertical portion. The nozzles 98a in the compartments 92a and 96a are disposed in parallel rows with their discharge portions facing away from the compartment 94a. Two parallel rows of nozzles 98a are provided in the compartment 94a with their discharge portions facing towards the partitions 88a and 90a, respectively. A single row of nozzles 100a is also located in the compartment 94a and extends between the two rows of nozzles 98a. The nozzles 100a are taller than the nozzles 98a for reasons to be explained. A manifold 102a is located in the plenum 28a and is connected to the nozzles 100a for supplying air to the nozzles 100a independently of the flow of air from the plenum 28a, through the plate 22 and to the nozzles 98a.

As shown in FIG. 4, a bank of heat exchange tubes 104a are disposed in each of the compartments 92a and 96a. The tubes 104a are bent into a serpentine pattern and extend between headers for circulating fluid through the tubes 104a in a conventional manner.

Three horizontally-spaced, elongated slots or openings 106a, 108a and 110a (FIG. 4) are provided through a portion of the partition 68a defining the compartments 92a, 94a and 96a, respectively. The opening 108a extends at an elevation higher than the openings 106a and 110a for reasons to be described. The openings are shown schematically in FIG. 4 for the convenience of presentation, it being understood that they actually are formed by cutting away the fins 74, or bending the tubes 72 out of the plane of the partition 68a. A plurality of openings 112a and 114a are formed in the lower portions of the partitions 88a and 90a, respectively, to communicate the chambers 92a and 96a with the chamber 94a. As shown in FIG. 2, the common wall 60 extends to the rear wall 16a to separate the recycle sections 32a and 32b and a plurality of openings 66 are provided in the extended portion of the common wall 60, for reasons to be described.

It is understood that the particular design of recycle sections 32a and 32b is shown as an example only and that a number of different embodiments of recycle sections may be used. For example, U.S. Pat. Nos. 5,054,436 and 5,040,492, both assigned to the assignee of the present application, disclose a number of different recycle section configurations that may be employed with the present invention. The disclosure of these references is incorporated herein by reference.

It is understood that the above description of the disclosure 12a is equally applicable to the enclosure 12b and identical structure in the latter embodiment is indicated by the same reference numerals but with a "b" suffix. Therefore, the enclosure 12b will not be described in detail.

A steam drum 116 (FIG. 1) is located above the system 10 and, although not shown in the drawings, it is understood that a plurality of headers are disposed at the ends of the various water-tube walls described above. As shown in general by the reference numeral 118, a plurality of downcomers, pipes, etc. are utilized to establish a flow circuit for circulating a cooling fluid such as water or steam or a water and steam mixture through these headers, the steam drum 116, and the various tubed walls, partitions, and heat exchange surfaces, with connecting feeders, risers, and headers being provided as necessary. Thus, water is passed in a predetermined sequence through this flow circuitry to convert the water to steam and to heat the steam by the heat generated by combustion of the particulate fuel material.

For ease of presentation, the operation of the present system will be described with reference to enclosure 12*a*. In operation, particulate material including fuel and sorbent material are introduced into the furnace section 30*a* through the feeder system 38*a*. Alternately, sorbent may also be introduced independently through openings formed through one or more of the enclosure walls. Air from an external source is introduced at a sufficient pressure into the plenum 26*a* extending below the furnace section 30*a*, and the air passes through the nozzles 36*a* disposed in the furnace section 30*a* at a sufficient quantity and velocity to fluidize the particulate material in the furnace section 30*a*. Each nozzle 36*a* is adjusted so that the velocity of the air discharged therefrom increases from right-to-left as viewed in FIG. 1, i.e., the nozzles 36*a* closest to the front wall 14*a* discharge air at a relatively high velocity while the nozzles 36*a* closest to the partition 24*a* discharge air at a relatively low velocity.

A liftoff burner (not shown), or the like, is provided to ignite the fuel material, and thereafter the fuel material is self-combusted by the heat in the furnace section 30*a*. Combustion of the fuel material generates combustion gases which mix with the air introduced through the plate 22*a*, which mixture is hereinafter referred to as flue gases. The flue gases pass upwardly through the furnace section 30*a* and entrain, or elutriate, a portion of the particulate material.

The quantity of particulate material introduced into the furnace section 30*a* and the quantity of air introduced, via the air plenum 26*a*, through the nozzles 36*a* and into the interior of the furnace section 30*a* is established in accordance with the size of the particulate material so that a dense bed is formed in the lower portions of the furnace section 30*a* and a circulating fluidized bed is formed in the upper portions thereof, i.e. the particulate material is fluidized to an extent that substantial entrainment or elutriation thereof is achieved. Operated in the above manner, the density of the particulate material is relatively high in the lower portion of the furnace section 30*a*, decreases with height throughout the length of the furnace section 30*a* and is substantially constant and relatively low in the upper portions of the furnace section 30*a*. Since the operation in the enclosure 12*b* is identical to that in the enclosure 12*a*, the former will not be described in detail.

As best shown in FIGS. 3 and 4, the openings 64 in the lower portion of the common wall 60 are sized to permit adequate flow of the particulate material between the furnace sections 30*a* and 30*b* so that the respective heights of the solids in the furnace sections 30*a* and 30*b* section are substantially the same.

Referring again to FIG. 1, the flue gases passing into the upper portion of the furnace section 30*a* are substantially saturated with the particulate material and pass, via the outlet opening in the upper portion of the rear wall 16*a*, into the cyclone separator 40*a*. The openings 62 (FIG. 3) in the upper portion of the common wall 60 equalize the gas pressure in the furnace sections 30*a* and 30*b* and thus eliminate any pressure drop across the common wall 60.

In the separator 40*a*, the particulate material is separated from the flue gases, and cleaned flue gases pass to the heat recovery section 48 for passage across the heat exchange surfaces 50. The separated particulate material passes from the separator 40*a*, through a dipleg 54*a*, J-valve 56*a*, and conduit 58*a*, and into the recycle section 32*a* as described above.

With reference to FIGS. 2 and 4, the separated solids from the conduit 58*a* enter the compartment 94*a* of the recycle section 32*a*. Assuming normal operation, the plenum chambers 26*a* and 28*a* selectively distribute the air through the nozzles 36*a* and 98*a*, respectively, to the furnace section 30*a* and the recycle section 32*a*. Each nozzle 36*a* and 98*a* is of conventional design and, as such, includes a control device to enable the velocity of the air passing therethrough to be controlled. During such normal operation, fluidizing air is introduced, via the plenum 28*a*, to the nozzles 98*a* in the compartments 92*a*, 94*a* and 96*a* of the recycle section 32*a*, while the air flow to the manifold 102*a*, and therefore to the nozzles 100*a*, is turned off. Since the two rows of nozzles 98*a* in the compartment 94*a* are directed towards the partitions 88*a* and 90*a*, the particulate material passes from the compartment 94*a* into the compartments 92*a* and 96*a*.

The particulate material mixes and builds up in the compartments 92*a* and 96*a* and thus gives up heat to the water/steam in the tubes 104*a* in those compartments. The cooled particulate material then passes through the openings 106*a* and 110*a* in the partition 68*a* through the channel 70*a* (FIG. 1), through the openings 34*a* in the partition 24*a*, and back into the furnace section 30*a*.

As shown in FIGS. 3 and 4, the openings 66 in the common wall 60 are sized to permit adequate flow of particulate material between the compartments 96*a* and 92*b* of the recycle sections 32*a* and 32*b*, respectively, so that the respective heights of the particulate material in the compartments 92*a*, 96*a*, 92*b* are maintained substantially the same.

Since, during the above operation there is no air introduced into the nozzles 100*a* in the compartment 94*a*, very little, if any, flow of particulate material occurs through the compartment 94*a* and opening 108*a*. During initial start up and low load conditions, the fluidizing air flow to the plenum 28*a* is turned off and the air flow to the manifold 102*a*, and therefore to the nozzles 100*a*, is turned on. As a result, the volume of particulate material in the compartments 92*a* and 96*a* slump and therefore seal these compartments from further flow. Thus, the separated particulate material from the conduit 58*a* passes directly through the compartment 94*a* and, after building up to the level of the opening 108*a*, passes through the opening 108*a*, through the channel 70*a*, through the openings 34*a* in the partition 24*a*, and back into the furnace section 30*a*. Since the compartment 94*a* does not contain heat exchange tubes 104*a*, start up and low load operation can be achieved without exposing the banks of tubes 104*a* to the hot recirculating particulate material.

If desired, secondary air may be introduced into the enclosure 12*a* via inlets 80*a* and 82*a*, the secondary air from inlet 80*a* passing through the spaces in the partition 76*a* and through the recycle section 32*a* before exiting through the lower two rows of nozzles 84*a* leading into the furnace section 30*a*. The secondary air from the inlet 82a is prevented from passing into the recycle section 32a by the partition 78a and therefore passes through the upper two rows of nozzles 84a leading into the furnace section 30a. The fluidizing air that is introduced into the recycle section 32a is controlled to entrain fine fuel particles in the recycle section. In this manner, fine fuel particles of approximately 1 to 10 micrometers in diameter are exposed to the secondary air from the secondary air inlet 80a and pass with the secondary air through the nozzles 84a into the furnace section 30a. The high oxygen content in the latter air promotes the combustion of these entrained fine fuel particles as they pass from the recycle section 32a, through the lower two rows of nozzles 84a and into the furnace section 30a.

Feed water is introduced into the flow circuit described above and is circulated therethrough in a predetermined sequence to convert the feed water to steam and to reheat and superheat the steam.

Also, drain pipes (not shown) may be provided for the furnace section 30a and recycle section 32a and for each furnace section and recycle section as desired for discharging spent particulate material, in a conventional manner.

The system and method of the present invention have several advantages. For example, in the embodiment of FIGS. 1–4, the use of two adjacent enclosures sections 12a and 12b sharing a common wall 60 enables the size of the system 10, and therefore the load capacity, to be increased without increasing the height of the system. Moreover, the provision of openings 64 and 66 provided in the lower portion of the common wall 60 equalizes the heights of the respective dense beds in the furnace sections 30a and 30b and recycle sections 32a and 32b, thus correcting for imbalances in the fuel feed from the feeder systems 38a and 38b, or the like. Further, since the adjacent enclosures 12a and 12b are substantially the same, a single control scheme can be utilized which controls the operation in both enclosures. Moreover, the provision of the openings 62 in the upper portion of common wall 60 enables the respective gas pressures in the furnace sections 30a and 30b to be equalized, thus minimizing or eliminating any lateral loading across the common wall 60 and possible damage. Also, the openings 62 enable a predetermined gas pressure drop to be set across the furnace sections 30a and 30b and enable the entrainment and circulation to be substantially the same in each furnace section 30a and 30b. Also, the provision of the openings 62 enables substantially the same combustion environments to be established above the dense bed in both furnace sections 30a and 30b.

Although the embodiment described above utilizes a single common wall 60 shared between two substantially identical enclosures 12a and 12b, it is understood that multiple common walls can be used in a similar manner to join additional enclosures. As examples of this, FIGS. 5 and 6 depict alternate embodiments of the present invention in which adjacent and opposing enclosures are joined by common walls.

Figure 5:
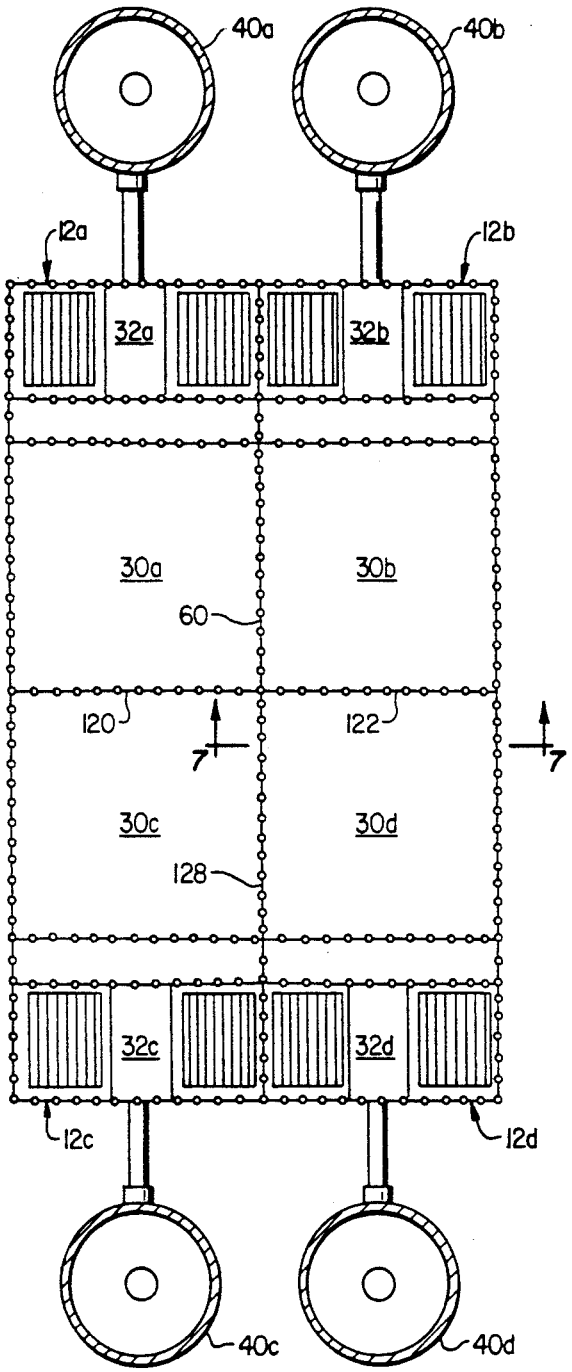
FIGS. 5 and 6 are views similar to FIG. 2 but depicting alternate embodiments of the system of the present invention.
Figure 7:
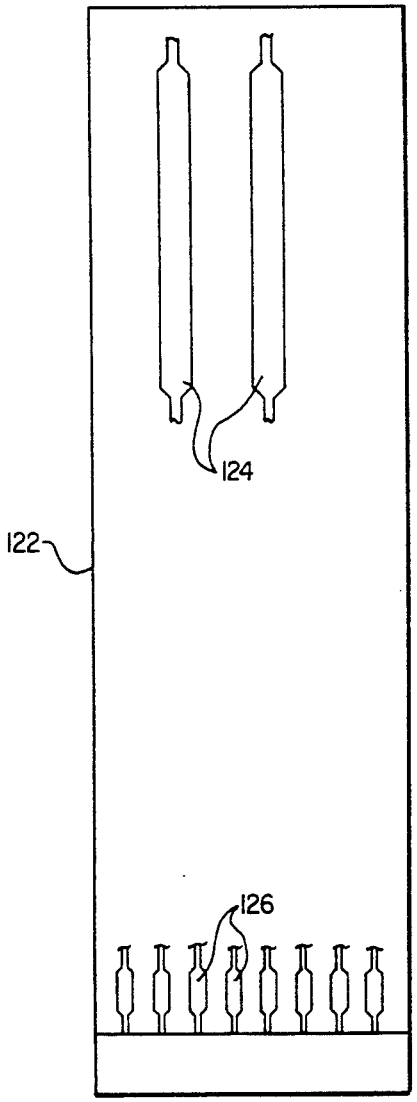
FIG. 7 is an enlarged cross-sectional view taken along the line 7—7 of FIG. 5.

According to the embodiment of FIG. 5, two more enclosures 12c and 12d, which are substantially similar to enclosures 12a and 12b, are joined with enclosures 12a and 12b. Enclosure 12c is disposed opposite enclosure 12a and adjacent enclosure 12d, and enclosure 12d is disposed opposite enclosure 12b. Enclosure 12a and enclosure 12c share a common wall 120, and enclosure 12b and enclosure 12d share a substantially identical common wall 122. As shown in FIG. 7, common wall 122 (and common wall 120) has a plurality of openings 124 in an upper portion for permitting flue gases to pass between the furnace sections joined thereby. The openings 124 equalize gas pressure in the joined furnace sections and thus eliminate any pressure drop across the common wall 122. The common wall 122 (and common wall 120) also has a plurality of openings 126 in a lower portion for permitting particulate material to flow between the furnace sections joined thereby. The openings 126 are sized to permit adequate flow of particulate material between the furnace sections joined thereby so that the respective heights of the dense beds in the furnace sections are substantially the same. The common wall 128 between enclosure 12c and enclosure 12d is substantially identical to common wall 60. Separators 40a, 40b, 40c, and 40d are associated with the respective enclosures 12a, 12b, 12c, and 12d in a substantially identical fashion as separator 40a is associated with enclosure 12a in the embodiment described in detail above. The separators 40a, 40b, 40c and 40d function in a substantially identical manner as separator 40a in the embodiment described in detail above. The embodiment of FIG. 5 thus functions in the same manner as described above in connection with the embodiment of FIGS. 1–4 while enjoying the added capacity and flexibility of the additional enclosures.

Figure 6:
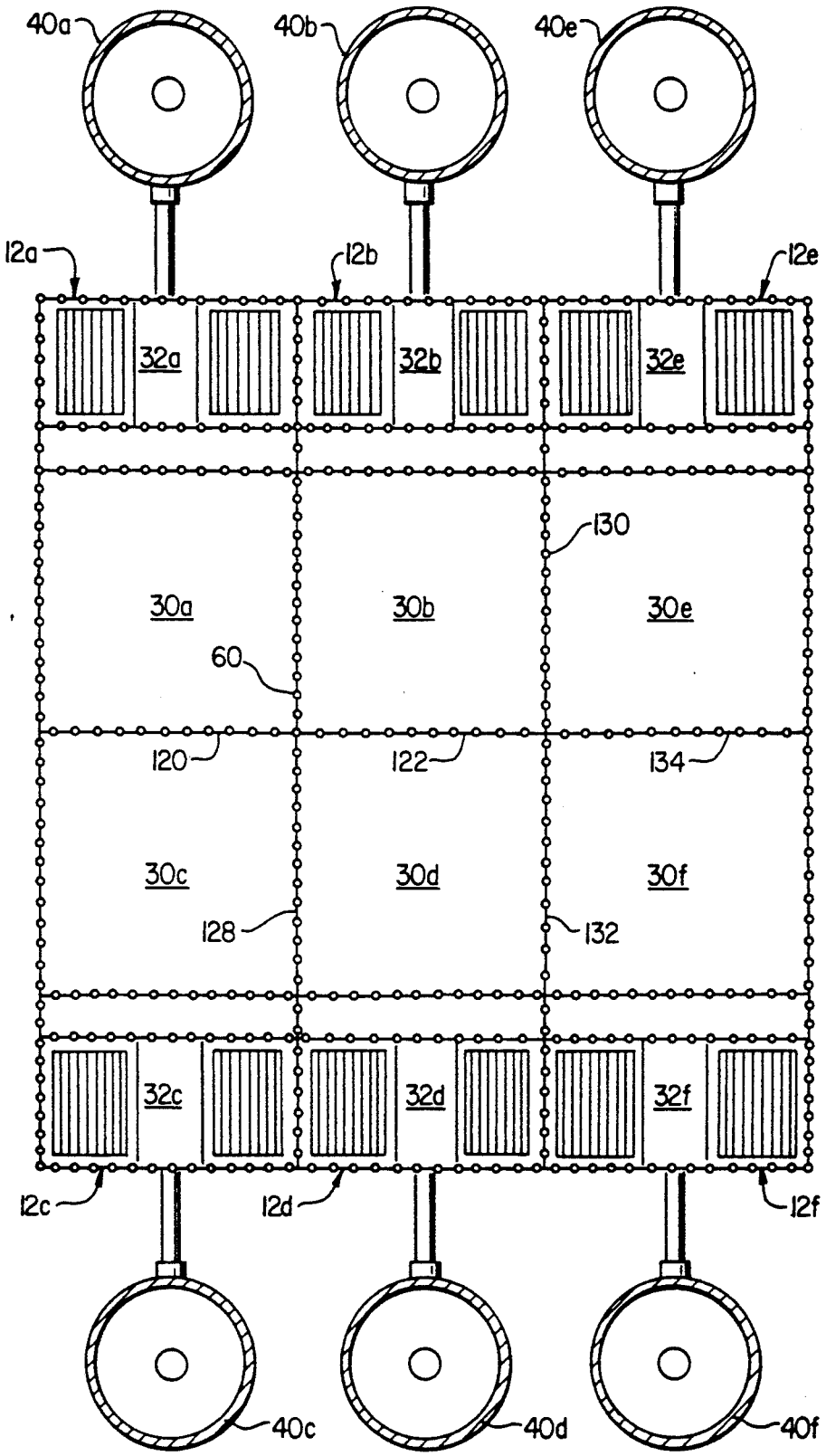

According to the embodiment of FIG. 6, two additional enclosures 12e and 12f, which are substantially similar to enclosures 12a, 12b, 12c, and 12d, are joined with enclosures 12a, 12b, 12c, and 12d. Enclosure 12e is disposed adjacent enclosure 12b and opposite enclosure 12f, and enclosure 12f is disposed adjacent enclosure 12d. Common walls 130 and 132, dividing enclosures 12b from 12e and 12d from 12f, respectively, are substantially identical to common walls 60 and 128. Similarly, common wall 134 dividing enclosure 12e from enclosure 12f, is substantially identical to common walls 120 and 122. Separators 40a, 40b, 40c, 40d, 40e, and 40f are associated with enclosures 12a, 12b, 12c, 12d, 12e, and 12f, respectively. The embodiment of FIG. 6 functions in the same manner as described above in connection with the embodiment of FIGS. 1–4 and the embodiment of FIG. 5 while enjoying the added capacity and flexibility of the additional enclosures.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising:

an enclosure having a front wall, a rear wall, a first side wall and a second side wall;

a partition extending between said side walls and dividing said enclosure into a furnace section and a recycle section;

means for introducing particulate material including fuel into said furnace section;

means for introducing particulate material into said recycle section;

means for passing particulate material from said recycle section to said furnace section;

a grate disposed in a lower portion of said enclosure for supporting said particulate material in said furnace section and said recycle section; and means for introducing an oxygen-containing gas through said grate and into said furnace section for fluidizing said particulate material in said furnace section; and said first side wall having at least one aperture in a lower portion of said side wall and registering with said recycle section so that said particulate material in said recycle section may pass through said aperture.

2. The system of claim 1 wherein:

said first side wall has at least one aperture in a lower portion of said side wall and registering with said furnace section so that said particulate material in said furnace section may pass through said aperture; and said first side wall has at least one aperture in an upper portion of said side wall and registering with said furnace section so that gases in an upper portion of said furnace section may pass through said aperture.

3. The system of claim 2 wherein:

said second side wall has at least one aperture in a lower portion of said side wall registering with said furnace section so that said particulate material in said furnace section may pass through said aperture;

said second side wall has at least one aperture in a lower portion of said side wall registering with said recycle section so that said particulate material in said recycle section may pass through said aperture; and said second side wall having at least one aperture in an upper portion of said side wall so that gases in an upper portion of said furnace section may pass through said aperture.

4. The system of claim 2 wherein:

said front wall has at least one aperture in a lower portion of said front wall registering with said furnace section so that particulate material in said furnace section may pass through said aperture; and said front wall has at least one aperture in an upper portion of said front wall so that gases in an upper portion of said furnace section may pass through said aperture.

5. The system of claim 2 wherein said first side wall is formed by a plurality of spaced cooling tubes connected by continuous fins to form an airtight structure, said apertures in said first side wall being provided by omitting said fins from between portions of said spaced tubes.

6. The system of claim 2 further comprising:

a second enclosure having a second furnace section and a second recycle section, said second enclosure being disposed adjacent said enclosure and sharing said first side wall so that said second furnace section is disposed adjacent said furnace section and said second recycle section is disposed adjacent said recycle section, said at least one aperture in said lower portion of said side wall and registering with said furnace section also registering with said second furnace section to permit particulate material to pass between said furnace section and said second furnace section, said at least one aperture in a lower portion of said side wall and registering with said recycle section also registering with said second recycle section to permit particulate material to pass between said recycle section and said second recycle section, and said at least one aperture in an upper portion of said side wall and registering with said furnace section also registering with said second furnace section to permit gases to pass between said furnace section and said second furnace section.

7. The system of claim 2 further comprising:

a separator disposed adjacent said enclosure for separating particulate material from gases;

means for passing particulate material from said upper portion of said furnace section to said separator; and wherein said means for introducing particulate material into said recycle section comprises a conduit for passing separated particulate material from said separator to said recycle section.

8. The system of claim 7 wherein said partition has a first portion extending substantially vertically from said grate and a second portion angling upwardly and rearwardly from said first portion and extending to said rear wall.

9. The system of claim 8 wherein said means for passing particulate material from said recycle section to said furnace section comprises:

a second partition disposed between said side walls in said recycle section and extending from said grate to said second portion of said partition to form a channel between said partition and said second partition, an upper portion of said second partition having an aperture for permitting particulate material to pass from said recycle section to said channel, and a lower portion of said partition having an aperture for permitting particulate material to pass from said channel to said furnace section.

10. The system of claim 8 wherein said partition is formed by a plurality of spaced cooling tubes connected by continuous fins to form an airtight structure, said apertures in said partition being provided by omitting said fins from between portions of said spaced tubes.

11. A fluidized bed combustion system comprising:

a first enclosure having a first furnace section;

a first recycle section adjoining said first furnace section;

means for forming a fluidized bed of particulate material including fuel in said first furnace section;

means for forming a fluidized bed of particulate material in said first recycle section;

means for passing particulate material from said first recycle section to said first furnace section;

a second enclosure having a second furnace section;

a second recycle section adjoining said second furnace section;

means for forming a fluidized bed of particulate material including fuel in said second furnace section;

means for forming a fluidized bed of particulate material in said second recycle section;

said first and second enclosure being disposed adjacently and sharing a common wall which divides said first furnace section and said first recycle section from said second furnace section and said second recycle section, said first furnace section being disposed adjacent said second furnace section and said first recycle section being disposed adjacent said second recycle section;

said common wall having at least one aperture extending through an upper portion of said common wall and registering with said first and second furnace sections for permitting gases to pass between said first and second furnace sections to equalize pressure in said furnace sections;

said common wall having at least one aperture extending through a lower portion of said common wall and registering with said first and second furnace sections for permitting particulate material to pass between said first and second furnace sections; and said common wall having at least one aperture extending through a lower portion of said common wall and registering with said first and second recycle sections for permitting particulate material to pass between said first and second recycle sections.

12. The system of claim 11 wherein said common wall is formed by a plurality of spaced cooling tubes connected by continuous fins to form an airtight structure, each of said apertures in said common wall being provided by omitting said fins from between portions of said spaced tubes.

13. The system of claim 11 further comprising:

a first separator disposed adjacent said first enclosure for separating particulate material from gases;

means for passing particulate material and gases from said first furnace section to said first separator;

means for passing separated particulate material from said first separator to said first recycle section;

a second separator disposed adjacent said second enclosure for separating particulate material from gases;

means for passing particulate material and gases from said second furnace section to said second separator; and means for passing separated particulate material from said second separator to said second recycle section.

14. The system of claim 13 wherein said first and second separators are cyclone separators.

15. The system of claim 13 wherein said first recycle section is located within said first enclosure and said second recycle section is located within said second enclosure.

16. The system of claim 15 wherein:

said first enclosure comprises a front wall, a rear wall, two side walls, and a first grate for supporting said first and second fluidized beds, said first recycle section being separated from said first furnace section by a first partition, said first partition being disposed between said side walls of said first enclosure, a first portion of said first partition extending substantially vertically from said first grate, and a second portion of said first partition angling upwardly and rearwardly from said first portion and extending to said first rear wall; and said second enclosure comprises a front wall, a rear wall, two side walls, and a second grate for supporting said third and fourth fluidized beds, said second recycle section being separated from said second furnace section by a second partition, said second partition being disposed between said side walls of said second enclosure, a first portion of said second partition extending substantially vertically from said second grate, and a second portion of said second partition angling upwardly and rearwardly from said first portion and extending to said second rear wall.

17. The system of claim 16 wherein said first and second partitions are formed by a plurality of spaced cooling tubes connected by continuous fins to form airtight structures, and each of said apertures in said first and second partitions are provided by omitting said fins from between portions of said spaced tubes.

18. The system of claim 16 wherein:

said means for passing particulate material from said first recycle section to said first furnace section comprises a third partition disposed between said side walls of said first enclosure and extending in said first recycle section from said first grate to said second portion of said first partition to form a first channel between said first partition and said third partition, an upper portion of said third partition having at least one aperture for permitting particulate material to pass from said first recycle section to said first channel, and a lower portion of said first partition having at least one aperture for permitting particulate material to pass from said first channel to said first furnace section; and said means for passing particulate material from said second recycle section to said second furnace section comprises a fourth partition disposed between said side walls of said second enclosure and extending in said second recycle section from said second grate to said second portion of said second partition to form a second channel between said second partition and said fourth partition, an upper portion of said fourth partition having at least one aperture for permitting particulate material to pass from said second recycle section to said second channel, and a lower portion of said second partition having at least one aperture for permitting particulate material to pass from said second channel to said second furnace section.

19. The system of claim 18 further comprising:

a fifth partition disposed between said side walls of said first enclosure, a lower portion of said fifth partition angling upwardly into said first recycle section from said first rear wall to said second portion of said first partition, and an upper portion of said fifth partition angling upwardly and rearwardly from said second portion of said first partition of said first rear wall, said lower portion of said fifth partition having at least one aperture; and a sixth partition disposed between said side walls of said second enclosure, a lower portion of said sixth partition angling upwardly into said second recycle section from said second rear wall to said second portion of said second partition, and an upper portion of said sixth partition angling upwardly and rearwardly from said second portion of said second partition to said second rear wall, said lower portion of said sixth partition having at least one aperture.

20. The system of claim 19 further comprising:

a first plurality of nozzles extending through said second portion of said first partition and into said first recycle section below a point of intersection of said fifth partition with said second portion of said first partition;

a second plurality of nozzles extending through said second portion of said second partition and into said second recycle section below a point of intersection of said sixth partition with said second portion of said second partition;

means for introducing an oxygen-containing gas through said first rear wall and into said first recycle section between points of intersection of said upper and lower portions of said fifth partition with said first rear wall so that said gas may create oxidizing conditions in said first nozzles for combusting fine particulate material passing through said first nozzles; and means for introducing an oxygen-containing gas through said second rear wall and into said second recycle section between points of intersection of said upper and lower portions of said sixth partition with said second rear wall so that said gas may create oxidizing conditions in said second nozzles for combusting fine particulate material passing through said second nozzles.

21. The system of claim 11 further comprising:

a third enclosure having a third furnace section;

a third recycle section adjoining said third furnace section;

means for forming a fluidized bed of particulate material including fuel in said third furnace section;

means for forming a fluidized bed of particulate material in said third recycle section;

means for passing particulate material from said third recycle section to said third furnace section;

a fourth enclosure having a fourth furnace section;

a fourth recycle section adjoining said fourth furnace section;

means for forming a fluidized bed of particulate material including fuel in said fourth furnace section;

means for forming a fluidized bed of particulate material in said fourth recycle section;

said third enclosure being disposed opposite and sharing a second common wall with said first enclosure; and said fourth enclosure being disposed opposite and sharing a third common wall with said second enclosure, and said fourth enclosure being disposed adjacent to and sharing a fourth common wall with said third enclosure;

said second common wall having at least one aperture extending through a lower portion of said wall and registering with said first and third furnace sections permitting particulate material to pass between said first and third furnace sections, and said second common wall having at least one aperture extending through an upper portion of said wall and registering with said first and third furnace sections permitting gases to pass between said first and third furnace sections;

said third common wall having at least one aperture extending through a lower portion of said wall and registering with said second and fourth furnace sections for permitting particulate material to pass between said second and fourth furnace sections, and said third common wall having at least one aperture extending through an upper portion of said wall and registering with said second and fourth furnace sections for permitting gases to pass between said second and fourth furnace sections;

said fourth common wall having at least one aperture extending through a lower portion of said wall and registering with said third and fourth furnace sections for permitting particulate material to pass between said third and fourth furnace sections, said fourth common wall having at least one aperture in a lower portion of said wall and registering with said third and fourth recycle sections for permitting particulate material to pass between said third and fourth recycle sections, and said fourth common wall having at least one aperture in an upper portion of said wall and registering with said third and fourth furnace sections for permitting gases to pass between said third and fourth furnace sections.

22. The system of claim 21 wherein said first recycle section is disposed within said first enclosure, said second recycle section is disposed within said second enclosure, said third recycle section is disposed within said third enclosure, and said fourth recycle section is disposed within said fourth enclosure.

23. The system of claim 21 further comprising:

a fifth enclosure having a fifth furnace section;

a fifth recycle section adjoining said fifth furnace section;

means for forming a fluidizing bed of particulate material including fuel in said fifth furnace section;

means for forming a fluidized bed of particulate material in said fifth recycle section;

means for passing particulate material from said fifth recycle section to said fifth furnace section;

a sixth enclosure having a sixth furnace section;

a sixth recycle section adjoining said sixth furnace section;

means for forming a fluidized bed of particulate material including fuel in said sixth furnace section;

means for forming a fluidized bed of particulate material in said sixth recycle section;

said fifth enclosure being disposed adjacent said second enclosure on a side opposite said first enclosure, and said fifth enclosure sharing a fifth common wall with said second enclosure;

said sixth enclosure being disposed opposite said fifth enclosure and adjacent said fourth enclosure, said sixth enclosure sharing a sixth common wall with said fifth enclosure and sharing a seventh common wall with said fourth enclosure;

said fifth common wall having at least one aperture in a lower portion of said wall and registering with said second and fifth furnace sections for permitting particulate material to pass between said second and fifth furnace sections, said fifth common wall having at least one aperture in a lower portion of said wall and registering with said second and fifth recycle sections for permitting particulate material to pass between said second and fifth recycle sections, and said fifth common wall having at least one aperture in an upper portion of said wall and registering with said second and fifth furnace sections for permitting gases to pass between said second and fifth furnace sections;

said sixth common wall having at least one aperture in a lower portion of said wall and registering with said fifth and sixth furnace sections for permitting particulate material to pass between said fifth and sixth furnace sections, and said sixth common wall having at least one aperture in an upper portion of said wall and registering with said fifth and sixth furnace sections for permitting gases to pass between said fifth and sixth furnace sections; and said seventh common wall having at least one aperture in a lower portion of said wall and registering with said fourth and sixth furnace sections for permitting particulate material to pass between said fourth and sixth furnace sections, said seventh common wall having at least one aperture in a lower portion of said wall and registering with said fourth and sixth recycle sections for permitting particulate material to pass between said fourth and sixth recycle sections, and said seventh common wall having at least one aperture in an upper portion of said wall and registering with said fourth and sixth furnace sections for permitting gases to pass between said fourth and sixth furnace sections.

24. The system of claim 23 wherein said first recycle section is disposed within said first enclosure, said second recycle section is disposed within said second enclosure, said third recycle section is disposed within said third enclosure, said fourth recycle section is disposed within said fourth enclosure, the fifth recycle section is disposed within said fifth enclosure, and said sixth recycle section is disposed within said sixth enclosure.

25. A method of operating a fluidized bed combustion system comprising the steps of:

providing a plurality of enclosures, each of said enclosures having a furnace section and a recycle section;

introducing particulate material including fuel into said furnace sections;

introducing particulate material into said recycle sections;

introducing an oxygen-containing gas into said furnace sections for fluidizing said particulate material in said furnace sections and for promoting combustion of said fuel to generate combustion gases in said furnace sections, and so that dense beds of particulate material having heights form in said furnace sections, and so that said fluidizing gas combines with said combustion gases to form flue gases which entrain a portion of said particulate material in said furnace sections;

introducing an oxygen-containing gas into said recycle sections for fluidizing said particulate material in said recycle sections so that dense beds of particulate material having heights form in said recycle sections;

equalizing said heights of said dense beds in said furnace sections;

equalizing pressure in said furnace sections; and equalizing said heights of said dense beds in said recycle sections.

26. The method of claim 25 wherein:

said step of equalizing said heights of said dense beds in said furnace sections comprises permitting particulate material to flow between said furnace sections;

said step of equalizing said pressure in said furnace sections comprises permitting said flue gases to flow between said furnace sections; and said step of equalizing said heights of said dense beds in said recycle sections comprises permitting particulate material to flow between said furnace sections.

27. The method of claim 26 further comprising:

passing a portion of said flue gases and said entrained particulate material from said furnace sections;

separating said passed, entrained particulate material from said flue gases; and wherein said step of introducing particulate material into said recycle sections comprises passing said separated particulate material to said recycle sections.

28. The method of claim 27 further comprising removing heat from said separated particulate material in said recycle sections.

29. The method of claim 27 wherein:

said particulate material in said recycle sections includes fine fuel particles; and further comprising controlling said fluidizing gas introduced into said recycle sections to entrain said fine fuel particles said dense beds in said recycle sections;

passing a portion of said entrained fine fuel particles from said recycle sections to said furnace sections; and introducing a secondary oxygen-containing gas into said recycle sections above said dense beds so that said secondary gas creates oxidizing conditions for combusting said entrained fine fuel particles as said entrained fine fuel particles pass from said recycle sections to said furnace sections.

* * * * *

UNITED STATES PATENT AND TRADEMARK OFFICE

CERTIFICATE OF CORRECTION

PATENT NO. : 5,299,532
DATED : April 5, 1994
INVENTOR(S) : David H. Dietz

It is certified that error appears in the above-indentified patent and that said Letters Patent is hereby corrected as shown below:

Column 2, line 11, "i" should be --in--.

Column 7, line 30, "liftoff" should be --lightoff-- .

Signed and Sealed this

Eighteenth Day of April, 1995

Bruce Lehman

*Attest:*

BRUCE LEHMAN

*Commissioner of Patents and Trademarks*

*Attesting Officer*